US005820441A

United States Patent [19]

Pracas

[11] Patent Number: 5,820,441

[45] Date of Patent: Oct. 13, 1998

[54] ANIMATED DOLL

[75] Inventor: Victor Manuel Pracas, Waroona, Australia

[73] Assignee: Inntoy Pty. Ltd., Shoalwater, Australia

[21] Appl. No.: 836,413

[22] PCT Filed: Sep. 27, 1995

[86] PCT No.: PCT/AU95/00635

§ 371 Date: Jun. 25, 1997

§ 102(e) Date: Jun. 25, 1997

[87] PCT Pub. No.: WO96/13312

PCT Pub. Date: May 9, 1996

[30] Foreign Application Priority Data

Oct. 27, 1994 [AU] Australia ..... PM 9078

[51] Int. Cl.[6] ..... A63H 3/00; A63H 3/20; A63H 3/28

[52] U.S. Cl. ..... 446/354; 446/295; 446/297; 446/304

[58] Field of Search ..... 446/130, 295, 446/297, 304, 354, 358

[56] References Cited

U.S. PATENT DOCUMENTS

| | | | |
|---|---|---|---|
| 1,483,127 | 2/1924 | Starbuck | 446/354 |
| 2,288,371 | 6/1942 | Rothschild | 446/354 |
| 4,139,968 | 2/1979 | Milner | 446/301 |
| 4,276,714 | 7/1981 | Albert et al. | 446/304 X |
| 4,699,603 | 10/1987 | Saigo et al. | 446/304 |
| 4,875,886 | 10/1989 | Sung | 446/354 X |
| 4,983,890 | 1/1991 | Satoh et al. | 318/3 |
| 5,158,492 | 10/1992 | Rudell et al. | 446/175 |
| 5,176,560 | 1/1993 | Wetherell et al. | 446/354 X |
| 5,224,896 | 7/1993 | Terzian | 446/354 X |
| 5,468,172 | 11/1995 | Basile | 446/354 X |

FOREIGN PATENT DOCUMENTS

| | | |
|---|---|---|
| 2023931 | 2/1994 | Canada . |
| 2441400 | 6/1980 | France . |
| 2917223 | 11/1980 | Germany . |
| 2193652 | 2/1988 | United Kingdom . |

*Primary Examiner*—John A. Ricci
*Attorney, Agent, or Firm*—Michael Best & Friedrich, LLP

[57] ABSTRACT

An animated doll having a head, torso, and limbs is provided with an animation mechanism for moving the limbs. The animation mechanism is housed in the torso and includes an electric motor, a cam wheel rotated by the motor, and a plurality of lever arms engaged with the cam wheel and pivotal as the wheel rotates. A plurality of pivotal members are provided, each extending into a respective limb. Each lever arm is engaged with a respective pivotal member to produce movement of the limbs in response to operation of the motor. The plane of rotation of the cam wheel and the plane of pivoting movement of the lever arms is parallel to the plane which passes through the torso and limbs. A switch may be provided to provide electric power to the motor. The switch may be a magnetically actuated switch located at the mouth of the doll; and a magnet to actuate the switch may be provided on a simulated feeding bottle or on clothing of a user. The doll may produce sounds such as crying, sucking, or a heart beat.

14 Claims, 10 Drawing Sheets

ANIMATED DOLL

FIELD OF THE INVENTION

The present invention relates to an animated doll and relates particularly, though not exclusively, to an animated toy baby human doll.

BACKGROUND TO THE INVENTION

Virtually every household is in possession of at least one toy doll, and usually many dolls, especially if there are children or grandchildren associated with the household. Toy dolls come in an immense variety of shapes and sizes and in appearance conform to varying degrees to the real life animal or human figure they are intended to represent. From the simple rag doll made of cloth material filled with stuffing, to the finely detailed and highly realistic human baby dolls made from ceramic, wooden or soft moulded plastics materials, children in every culture enjoy playing with dolls. Toy dolls encourage children to use their imaginations and to role play human relationships. Young girls in particular find great enjoyment and satisfaction in exploring parental role models by play acting with a doll, placing themselves in the role of parent with the doll in the role of child. For this reason, it is not uncommon for a strong bond to develop between the child and the doll, and for the doll to develop a unique "personality" in the mind of the child.

Doll manufacturers recognise that the formation of a strong bond between the child and a toy doll, enhances enormously its "play value". The play value of a toy is an attempt to place a value on its capacity to hold a child's attention and interest, and to keep the child amused. This involves a somewhat subjective judgement, but generally it is thought that increasing the number of moving parts, incorporating various simulated physiological functions, including sounds, and/or improving the life-like appearance of a doll enhances its play value. Nevertheless, such features in themselves will not evoke the interest and involvement of a child unless the child's imagination is stimulated and an emotional attachment is formed.

Most prior art dolls are immobile, although with many the arms, legs and head can be moved to various positions. Some known toy robots have moving arms and can move about the floor on wheels. However, such movements are mechanical by nature and extremely predictable so that the child quickly loses interest and the toy is discarded.

SUMMARY OF THE INVENTION

The animated doll of the present invention was developed with a view to providing a doll that moves in response to an external stimulus so that when embodied in a form of a toy doll, the emotional attachment of a child to the doll can be enhanced and its play value thereby increased. Although the following description will be given primarily with reference to a toy doll, it is to be understood that the animated doll may also be embodied in the form of an educational aid that can be used, for example, to demonstrate and/or teach mother-care skills.

According to one aspect of the present invention there is provided an animated doll having a head, torso and limbs, the doll further comprising:

an animation mechanism for moving a plurality of limbs of the doll, said animation mechanism being housed in a casing adapted to be received within the torso of the doll and comprising:

an electric motor;

a plurality of pivotal members, each pivotal member being adapted to extend into one of said plurality of movable limbs of the doll to transmit a pivoting movement to the limb;

a cam means comprising a plurality of lever arms each connected to one of said pivotal members and having a cam follower that engages with a wheel cam operatively coupled to said electric motor, a plane of rotation of said wheel cam and a plane of pivoting movement of said lever arms being substantially parallel to a plane that passes through both said torso and said plurality of limbs of the doll, wherein said cam means is adapted to produce an unco-ordinated movement of said plurality of limbs of the doll which appears to be less mechanical in nature and more life-like; and, a sensing means for detecting an external stimulus applied to the doll and for activating the animation mechanism when said external stimulus is detected whereby, in use, the doll appears to respond to the external stimulus by moving said plurality of limbs.

According to another aspect of the present invention there is provided an animation mechanism for moving a plurality of limbs of a doll having a head and torso, the mechanism comprising:

an electric motor;

a plurality of pivotal members, each pivotal member being adapted to extend into one of said plurality of movable limbs of the doll to transmit a pivoting movement to the limb;

a cam means comprising a plurality of lever arms each connected to one of said pivotal members and having a cam follower that engages with a wheel cam operatively coupled to said electric motor, a plane of rotation of said wheel cam and a plane of pivoting movement of said lever arms being substantially parallel to a plane that passes through both said torso and said plurality of limbs of the doll, wherein said cam means is adapted to produce an unco-ordinated movement of said plurality of limbs of the doll which appears to be less mechanical in nature and more life-like.

Preferably the animation mechanism further comprises a transmission means for transmitting and converting a relatively high speed rotation of the electric motor to a relatively low speed rotation of said wheel cams.

Typically said transmission means is in the form of a gear train which is housed within said casing.

Advantageously said animation mechanism further comprises a sound generating means operatively connected to said sensing means and adapted to generate a sound when said external stimulus is detected. Preferably said animation mechanism also incorporates a heart beat mechanism operatively connected to the said sensing means and adapted to generate a simulated heart beat when said external stimulus is detected. Advantageously said heart beat mechanism is provided with a vibration transmitting member that terminates on a plate arranged external to said casing and located generally in the region where the sternum of the doll should be whereby, in use, said heart beat can be felt by touching the doll in the region of the sternum.

Typically said sound generating means comprises an electronic circuit and a small audio transducer and is adapted to produce at least two different sounds, namely a suckling sound and a crying sound. In the illustrated embodiment said sensing means comprises a magnetic switch located within the head of the doll in the general region of the mouth and said external stimulus is produced by a magnetic field brought into close proximity to the mouth of the doll.

In the described embodiment, which is in the form of a toy baby human doll, a permanent magnet may be sewn into a garment to be worn by a child playing with the doll, or within the end of a toy feeding bottle. When the doll is held by the child in a certain position, for example a suckling position, or is fed from the toy feeding bottle, the magnetic switch activates the animation mechanism and the doll produces a suckling sound whilst simultaneously moving its limbs. If the doll's sternum is in contact with the child while it is being held, the child will also feel the simulated heart beat. The combined effect of the doll's movement, the sounds produced and the heart beat is to evoke a strong emotional response in the child. The child's innate maternal/paternal instinct may be aroused and a degree of bonding may occur between the doll and the child. In this way the child's imagination and emotional involvement is stimulated and the attachment of the child to the doll is enhanced, which greatly increases its play value.

In the described embodiment, the sound generating means is arranged to emit a crying sound when the external stimulus is removed. The crying sound may be muted when the doll has been producing a suckling sound continuously for a predetermined time interval, indicating to the child that the baby has been sufficiently fed.

The present invention also includes within its scope means, such as a garment, adapted to apply said external stimulus to the doll. The garment may include a carry means for carrying the doll in a certain position.

BRIEF DESCRIPTION OF THE DRAWINGS

In order to enable the reader to understand more fully the nature of the present invention, a preferred embodiment of the animated doll and animation mechanism will now be described in detail, by way of example only, with reference to the accompanying drawings, in which.

DETAILED DESCRIPTION OF PREFERRED EMBODIMENTS

Figure 1:
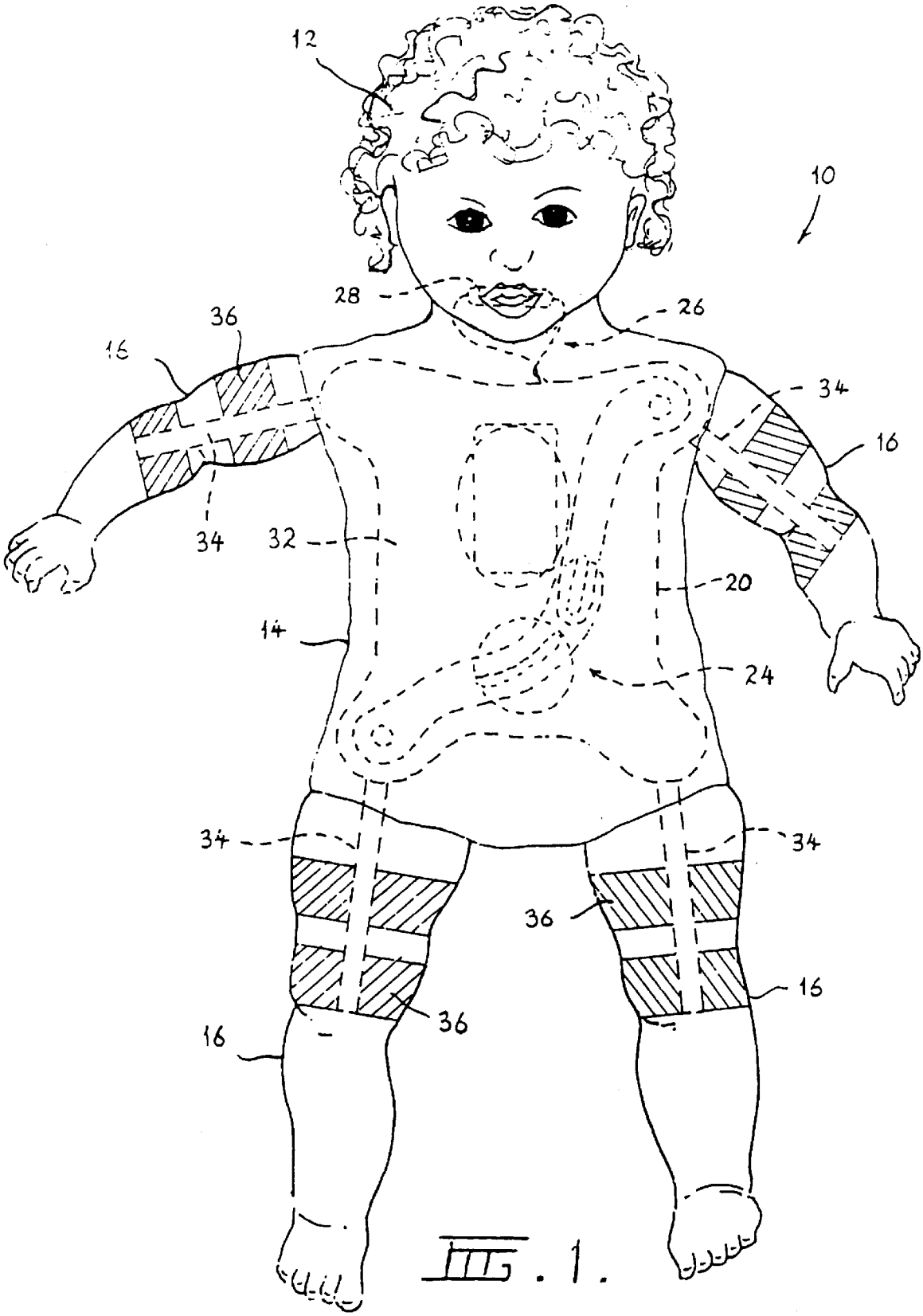
FIG. 1 illustrates a doll showing in outline a preferred embodiment of the animation mechanism provided therein.

FIG. 1 illustrates a preferred embodiment of the animated doll according to the invention, in the form of a toy baby human doll 10. The doll 10 has a head 12, torso 14 and limbs 16. In this embodiment of the doll, the torso 14 is made from soft cloth material, whereas the head 12 and limbs 16 are made from resilient moulded plastics material. An animation mechanism 20 is received within the torso 14 of the doll and is designed to move all four limbs 16 of the doll. As can be seen more clearly in FIG. 2, animation mechanism 20 comprises an electric motor 22 and a cam means 24 operatively coupled to the motor 22 and adapted to convert a rotary motion of the motor 22 to a pivotal movement of each of the limbs 16 of the doll. The animation mechanism further comprises a sensing means 26 for detecting an external stimulus applied to the doll 10 and for activating the animation mechanism 20 when the external stimulus is detected so that the doll 10 appears to respond to the external stimulus by moving its limbs 16.

In this embodiment, sensing means 26 comprises a magnetic switch 28 connected to an electronic circuit 30, (see FIG. 4), with the magnetic switch 28 located within the head 12 of the doll in the general region of the mouth. The external stimulus may be produced by a magnetic field brought into close proximity to the mouth of the doll 10. The animation mechanism 20 is housed within a generally rectangular casing 32 and further comprises four pivotal members 34 which are operatively coupled to the cam means 24 and are adapted to extend into each of the limbs 16 respectively of the doll 10, to transmit movement to the limbs 16.

The limbs 16 are generally hollow inside and are supported on the pivotal members 34 by means of foamed plastics material 36 provided within the hollow confines of the limbs 16. The foamed plastics material has a bore extending therethrough within which the respective pivotal member 34 is received in a tight fit. The foamed plastics material 36 may be provided in two or more sections as illustrated in FIG. 1, or may be provided in a single piece which substantially fills the interior of each limb 16. The foamed plastics material 36 not only supports the limbs 16 on the pivotal members 34 but also allows the limbs 16 to be squeezed without compromising the connection of the limbs 16 to the pivotal members 34. As can be seen most clearly in FIGS. 2 and 3 each of the pivotal members 34 are connected to the animation mechanism 20 by means of a resilient means, in this embodiment a small, stiff coil spring 38. The coil spring 38 allow the arms to be bent at the shoulders, and the legs to be bent at the hips without damaging the pivotal connection of the pivotal members 34 to the animation mechanism 20.

The preferred embodiment of the animation mechanism 20 will now be described in greater detail with reference to FIGS. 2 to 7.

Figure 2:
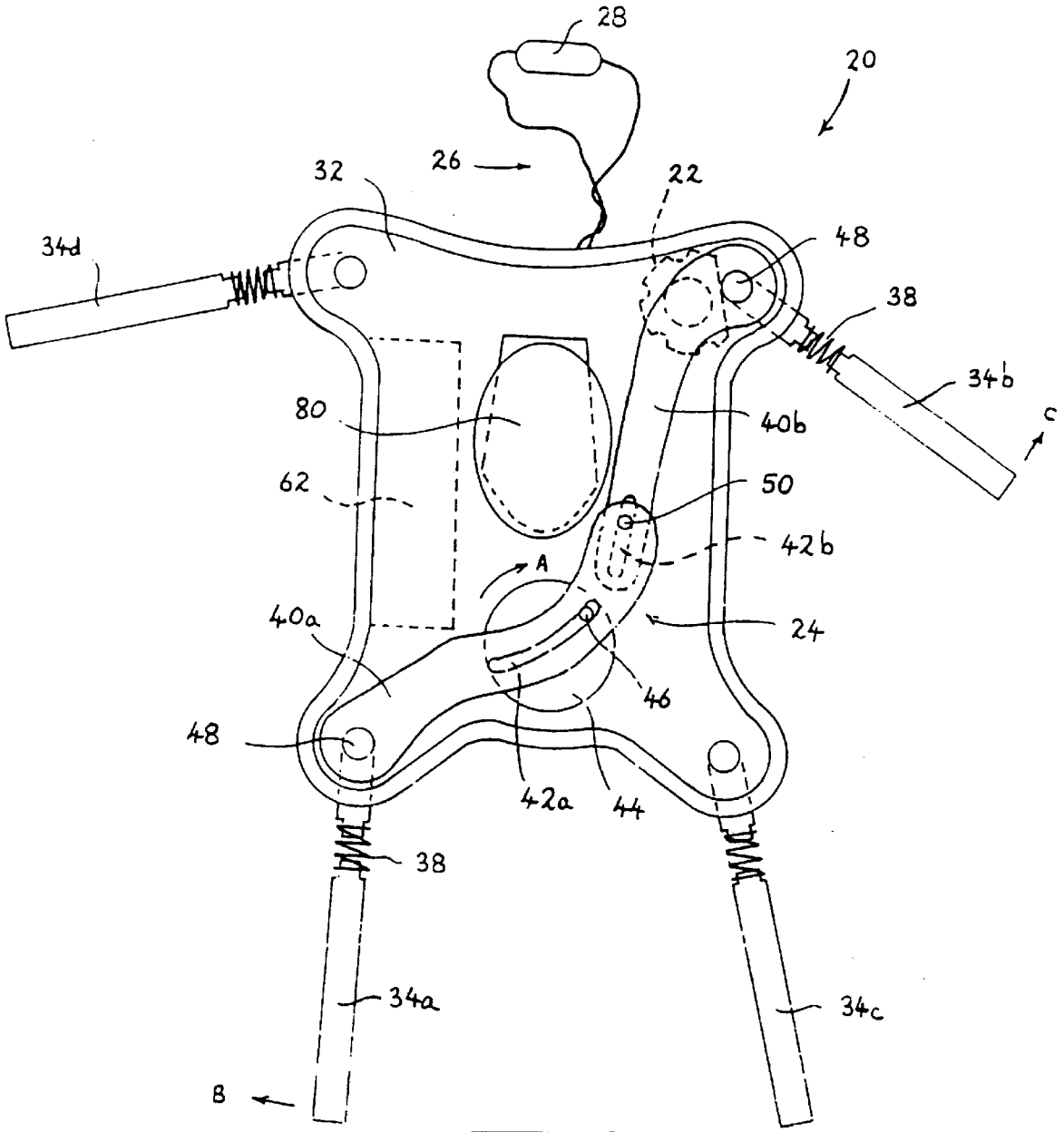
FIG. 2 is a plan view of the animation mechanism viewed from the front of the doll.
Figure 3:
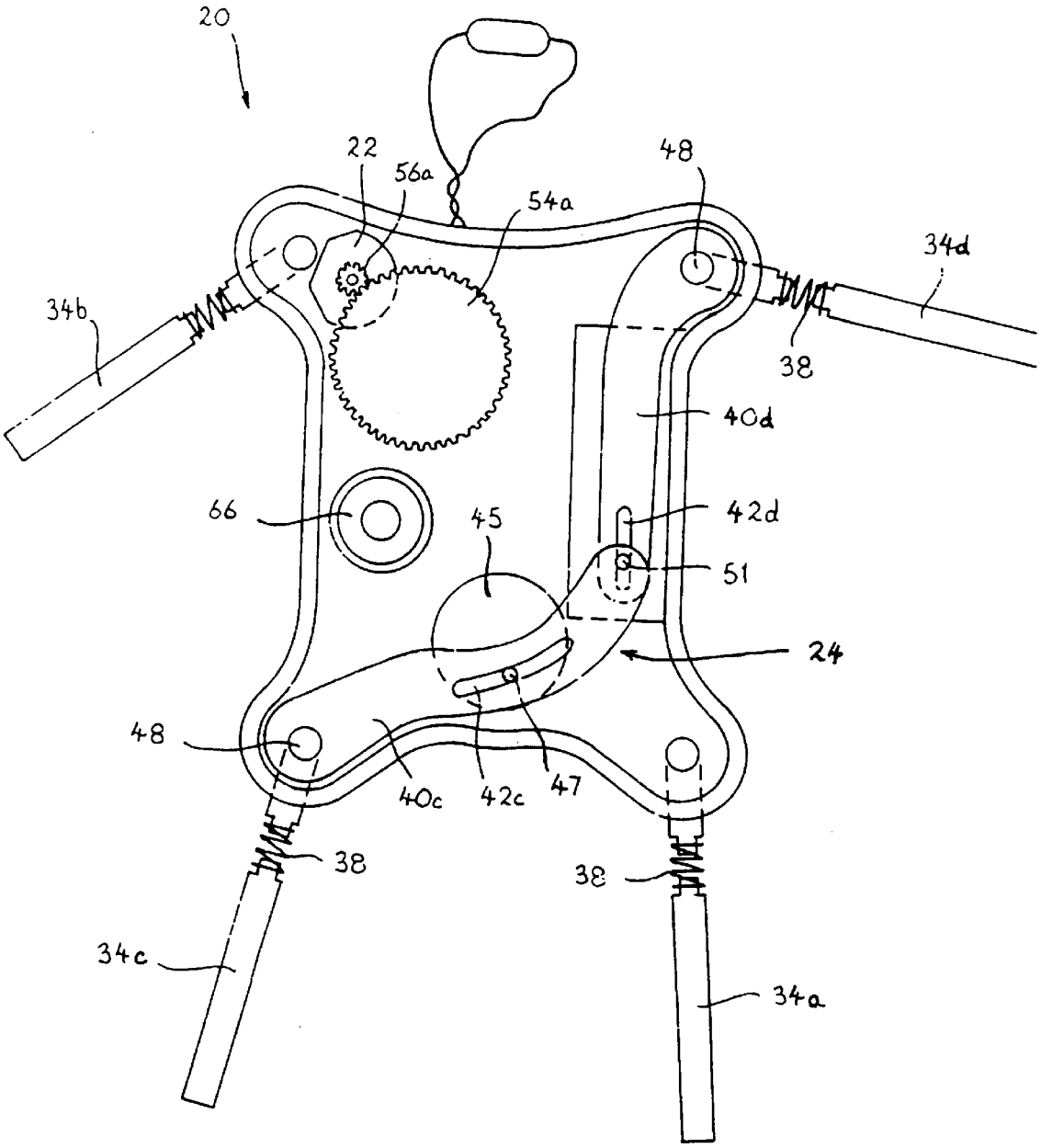
FIG. 3 is a plan view of the animation mechanism viewed from the back of the doll.

Cam means 24 of the animation mechanism 20 comprises four lever arms 40 connected to each of the pivotal members 34 respectively. FIG. 2 illustrates the animation mechanism 20 in plan view viewed from the front of the doll. It will be seen that lever arm 40*a* connects to the pivotal member 34*a* of the doll's right leg, whereas lever arm 40*b* connects to the pivotal member 34*b* of the doll's left arm. On the other hand, FIG. 3 is a plan view of the animation mechanism 20 viewed from the back of the doll. It will be seen that lever arm 40*c* connects to the pivotal member 34*c* of the doll's left leg, where as lever arm 40*d* connects to the pivotal member 34*d* of the doll's right arm.

Lever arm 40*a* has a cam follower in the form of a slot 42*a* that engages with a wheel cam 44 operatively coupled to the electric motor 22. Wheel cam 44 is provided with a pin 46, fixed at right angles to the plane of the wheel cam 44, which is slidably received in the slot 42*a*. It will be seen therefore that as cam wheel 44 rotates, pin 46 slides within the slot 42*a* and produces an oscillating pivoting movement of the lever arm 40*a*. Lever arm 40*a* is connected to the pivotal member 34*a* by means of a pivotally mounted shaft 48 to which the pivotal member 34*a* is fixed substantially at right angles thereto. Pivotal movement of the lever arm 40*a* produces a corresponding pivotal movement of the pivotal member 34*a* and hence of the right leg 16 of the doll 10.

Lever arm 40*b* is likewise connected to the pivotal member 34*b* for the left arm 16 of the doll by means a pivotal shaft 48. Lever arm 40*b* is also provided with a cam follower 42 in the form of a slot 42*b*. A pin fixed at right angles to the end of the lever arm 40*a* is slidably received within the slot 42*b* and transmits an oscillating pivoting movement to the lever arm 40*b* during rotation of the cam wheel 44.

Referring to FIG. 2, as cam wheel 44 rotates in the direction of arrow A from the illustrated position, lever arm 40*a* will be caused to pivot in a downwards direction producing a corresponding pivoting movement of pivotal member 34 in the direction of arrow B. Simultaneously, lever arm 40*b* is caused to pivot in an anti- clockwise direction producing a corresponding pivoting movement of the pivotal member 34*b* in the direction of arrow C. However, as pin 46 of cam wheel 44 completes its revolution the lever arms 40*a*, 40*b* will then be caused to pivot in the opposite direction producing a corresponding pivoting movement of the members 34*a*, 34*b* in the opposite direction.

Referring to FIG. 3, the reverse side of the animation mechanism 20 is provided with a substantially identical cam means 24, comprising lever arms 40*c*, 40*d* and a wheel cam 45. Lever arm 40*c* is provided with a cam follower slot 42*c* which engages with a pin 47 fixed to the wheel cam 45. A pin 51 provided at the end of lever arm 40*c* engages with a cam follower slot 42*d* provided in the lever arm 40*d*. Wheel cam 45 is connected to the wheel cam 44 by a common shaft (not visible) and is shown in the same position in the two views of FIGS. 2 and 3 respectively. It will be seen therefore that pin 47 on wheel cam 45 is not aligned with the pin 46 of wheel cam 44. Hence the pivotal movement of the lever arms 40*c*, 40*d* will be out of phase with the pivotal movement of the lever arms 40*a*, 40*b*. The out of phase rotation of wheel cams 44, 45, together with the shape and position of the cam follower slot 42 produces an uncoordinated movement of the pivotal members 34, so that the overall effect is that the movement of the limbs 16 of the doll appear to be less mechanical in nature and more life-like.

In this embodiment of the animation mechanism 20 the relatively high speed rotation of electric motor 22 is transmitted and converted to the relatively low speed rotation of the cam wheels 44, 45 by a transmission means in the form of a gear train housed within the casing 32.

As can be seen most clearly in FIGS. 5, 6, 7 and 8 the casing 32 for the animation mechanism 20 comprises first and second support plates 52 which are spaced apart and between which the electric motor 22 is supported and the shafts 48 for each of the pivotal members 34 are pivotally mounted. Also mounted between the support plates 52 are a plurality of gear wheels 54, 56 forming a gear transmission for transmitting the rotation of the electric motor 22 to the wheel cams 44, 45. The large gear wheel 54*a* is connected to a first gear shaft 58*a* and meshes with a small diameter gear wheel 56*a* provided on the shaft of the motor 22. A small diameter gear wheel 56*b* provided on shaft 58*a* meshes with a large diameter gear wheel 54*b* provided on a second gear shaft 58*b*. A small diameter gear wheel 56*c* provided on shaft 58*b* meshes with a large diameter gear wheel 54*c* provided on a gear shaft 58*c*. A small diameter gear wheel 56*d* on shaft 58*c* meshes in turn with a large diameter, gear wheel 54*d* on gear shaft 58*d*. Gear shaft 58*d* is connected at each end to the wheel cams 44, 45 respectively.

The gear ratio between each of the large gear wheels 54 and small gear wheels 56 is approximately 1:6, so that the total gear ratio between the gear shaft 58*d* and the shaft of electric motor 22 is approximately 1:1300. The speed of rotation of electric motor 22 is approximately 7000 to 10000 revolutions per minute (RPM), so that during operation of electric motor 22 the wheel cams 44, 45 rotate at approximately 5 to 8 RPM. One revolution of the wheel cams 44, 45 corresponds to a single cycle of the pivoting movement of the limbs 16 of the doll. Clearly the cycle time for the pivoting movement of the limbs 16 of the doll can be varied by changing the overall gear ratio provided by the gear transmission. Furthermore, such a high gear ratio is not required if the electric motor is a relatively slow speed motor. If desired, a variable speed motor can be employed.

Electric motor 22 is powered by two 1.5 volt batteries 60 held in a battery housing 62, and under the control of electronic control circuit 30. An electric switch 64 controls the supply of electrical power to the control circuit 30. This embodiment of the animation mechanism 20 also includes a sound generating means comprising a small audio transducer in the form of loud speaker 66 (see FIGS. 3, 6 and 7) which is connected to the control circuit 30. Control circuit 30 includes a sound generating IC for producing a plurality of sounds. In this embodiment, the sound generating IC is programmed to produce both a suckling sound and a crying sound, however, obviously other sounds may also be incorporated, for example speech sounds.

Furthermore, the animation mechanism 20 of this embodiment also includes a heart beat mechanism 70 housed within the casing 32 for generating a simulated heart beat. Heart beat mechanism 70 can be seen in FIG. 6 and comprises a solenoid 72 which is also powered by the battery 60 under the control of control circuit 30. An armature 74 is mounted adjacent the solenoid 72 and is separated from a core 76 of the solenoid by an air gap. Armature 74 comprises a block of ferrous metal mounted on an arm of spring steel which makes contact with the core 76 of the solenoid when electrical power is applied thereto. A vibration transmitting member in the form of a rod 78 of rigid material is connected to the core 76 of the solenoid, and terminates on an elliptical shaped plate 80 arranged external to the casing 32 and located generally in the region where the sternum of the doll would be located. Control circuit 30 supplies a pulsed electrical signal to the solenoid 72 which produces a rhythmic vibration of armature 74 on the core 76 of the solenoid. This vibration is in turn transmitted to the sternum plate 80 which can be felt as a simulated heart beat by touching the doll in the region of the sternum. Vibration transmitting rod 78 passes through an aperture provided in the support plate 52 of the casing 32.

Figure 4:
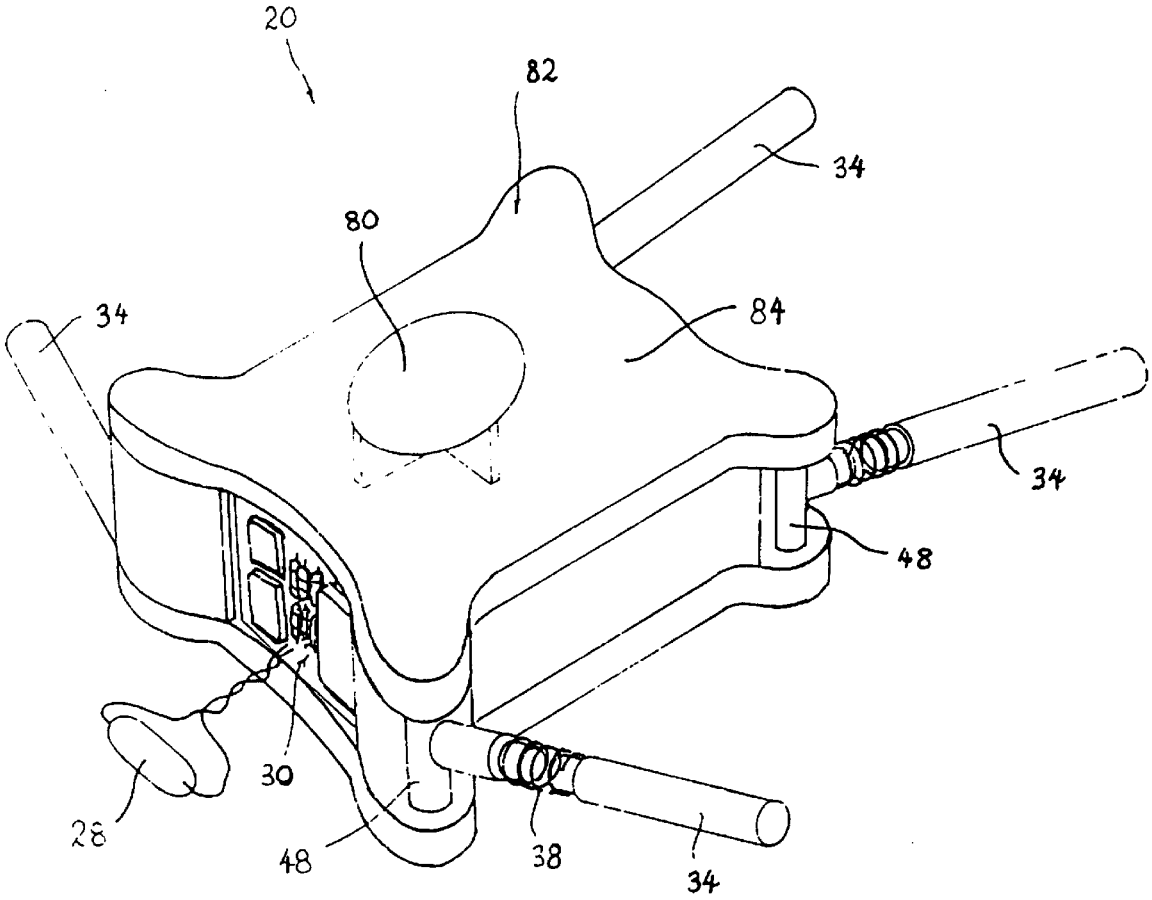
FIG. 4 is a perspective view of the animation mechanism viewed from the front.
Figure 5:
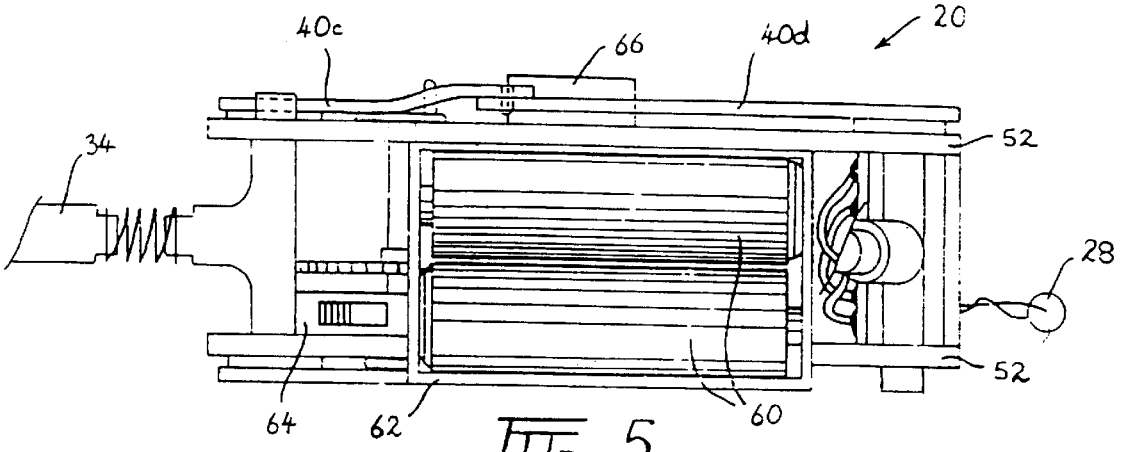
FIGS. 5 and 6 are side elevations of the animation mechanism viewed from both sides respectively.
Figure 6:
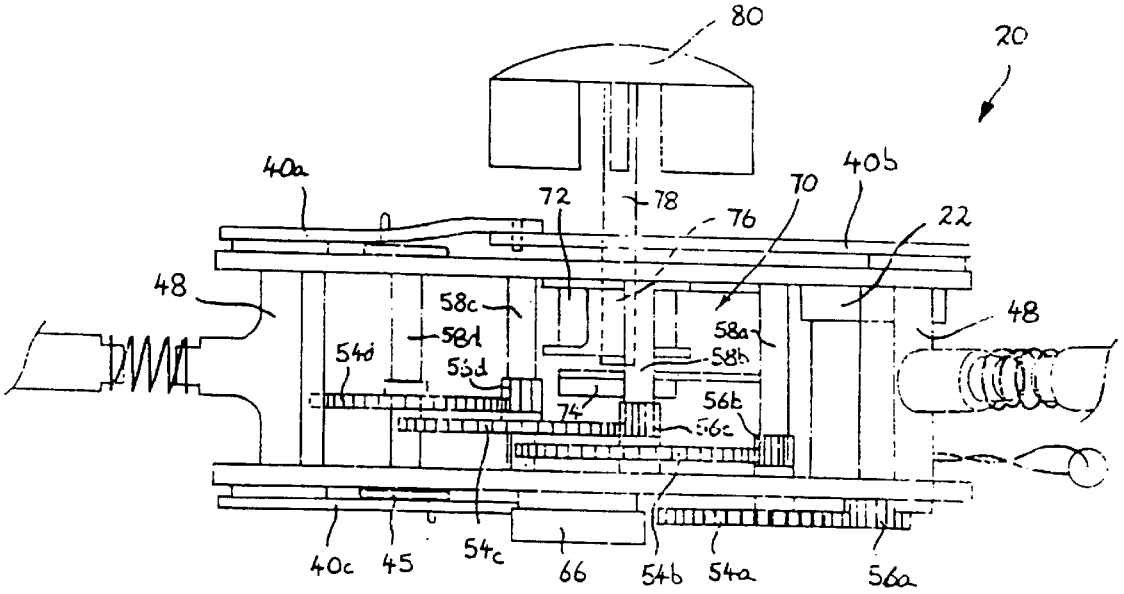
Figure 7:
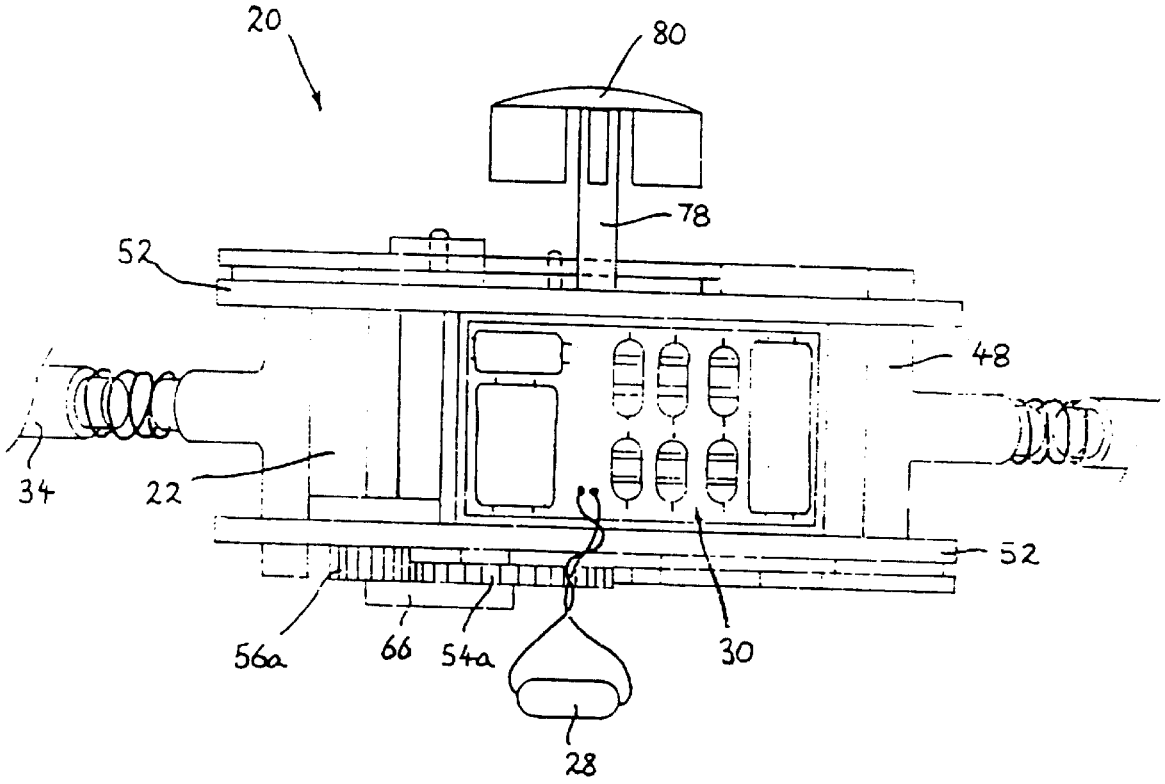
FIG. 7 is a side elevation of the animation mechanism viewed from the top.
Figure 8:
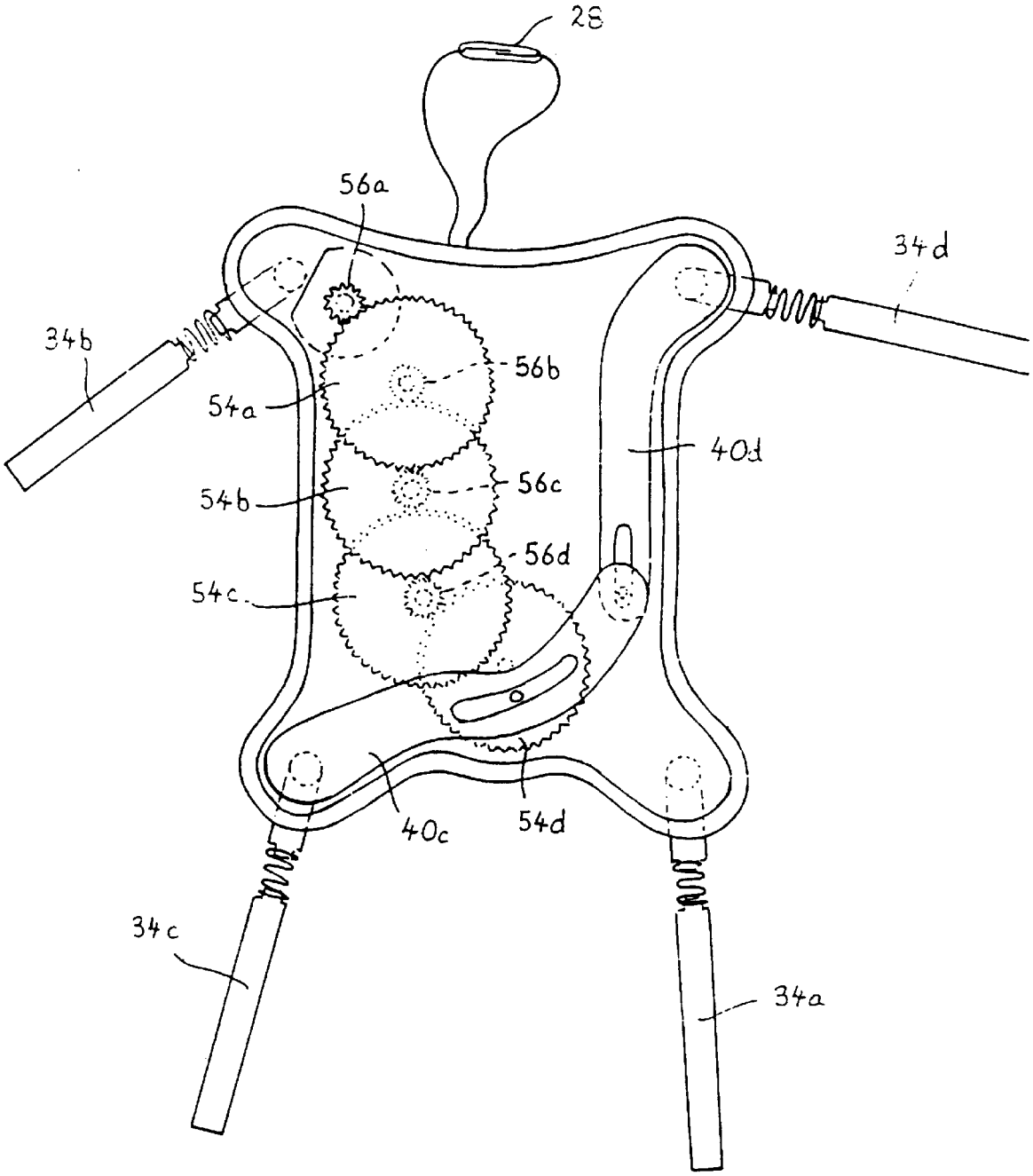
FIG. 8 is a plan view of the animation mechanism similar to FIG. 3 showing the arrangement of a gear train in the mechanism.

Casing 32 also includes an external cover 82 which encloses all four sides of the generally rectangular casing, and includes two cover plates 84 for enclosing the cam means 24 on the front and back sides respectively of the mechanism as shown in FIG. 4. The cover plates 84 are supported on edge walls 86 which extend around substantially the whole periphery of the casing 32 and protrude outwards from the outer surfaces of the support plates 52. Edge walls 86 have been omitted from FIGS. 5, 6 and 7 so that the lever arms 40, wheel cams 44, 45 and gear wheels 54*a*, 56*a* are visible. Cover 82 substantially encloses the animation mechanism 20 and prevents the surrounding stuffing in the torso 14 of the doll from interfering with the free movement of the cam means 24 and other moving parts of the mechanism 20. Sternum plate 80 is mounted external to the cover 82 and protrudes outwardly from the mechanism so that it locates as closely as possible to the outer surface of the torso of the doll.

The operation of the illustrated embodiment of the doll 10 incorporating the animation mechanism 20 will now be described in more detail.

Figure 13:
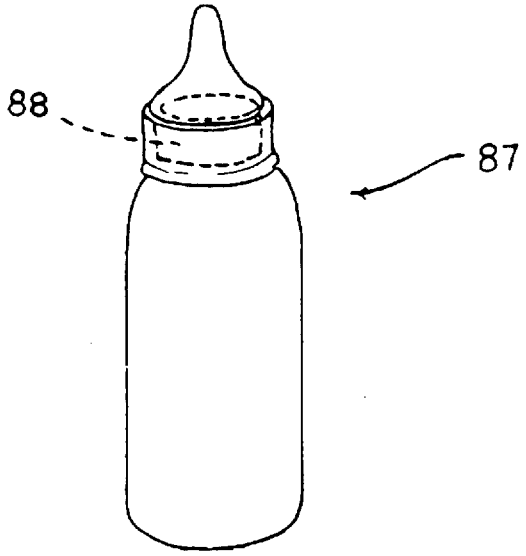
FIG. 13 illustrates a toy feeding bottle which can be used with the doll of FIG. 1.

Magnetic switch 28 is in a normally opened condition, so that the animation mechanism 20 remains in a passive state even when the electrical switch 64 is switched ON to deliver power to the control circuit 30. However, when an external stimulus in the form of a magnetic field is brought into close proximity to the mouth of the doll 10, magnetic switch 28 closes and signals the control circuit 30 to activate the animation mechanism 20. The external stimulus may be provided, for example, by a permanent magnet located within the end of a toy feeding bottle 87 illustrated in FIG. 13. Feeding bottle 37 has a small permanent magnet 88 located under the lid, which generates a magnetic field of sufficient strength to close the magnetic switch 28 when the teat of the bottle 87 is placed near the mouth of the doll 10.

Alternatively, the external stimulus may be provided by a permanent magnet sewn into a garment to be worn by a child playing with the doll 10. Several possible garments are described in greater detail below.

When magnetic switch 28 closes electric motor 22 is activated by the control circuit 30 and the animation mechanism 20 causes the arms and legs 16 of the doll 10 to start moving. Simultaneously, the sound generating IC sends a signal to the loud speaker 66 to produce a suckling sound and the heart beat mechanism 70 is activated to produce a simulated heart beat. Hence by feeding the doll, the child is rewarded by the responsive movement of the doll's arms and legs, a contented suckling sound and the reassuring heart beat which can be felt by the child. Should the child stop feeding the doll, the external stimulus is removed and magnetic switch 28 returns to the open condition. Control circuit 30 then deactivates the electric motor 22 and the heart beat mechanism 70 after a predetermined time interval. However, the sound generating IC may be programmed to switch over to a crying sound instead, which motivates the child to recommence feeding of the doll. The sound generating IC may by programmed to produce an intermittent crying sound and may incorporate a timing mechanism so that if the suckling sound has been produced continuously for a predetermined time interval, the crying sound will be muted when the external stimulus is removed, indicating to the child that the baby has been sufficiently fed.

Figure 10:
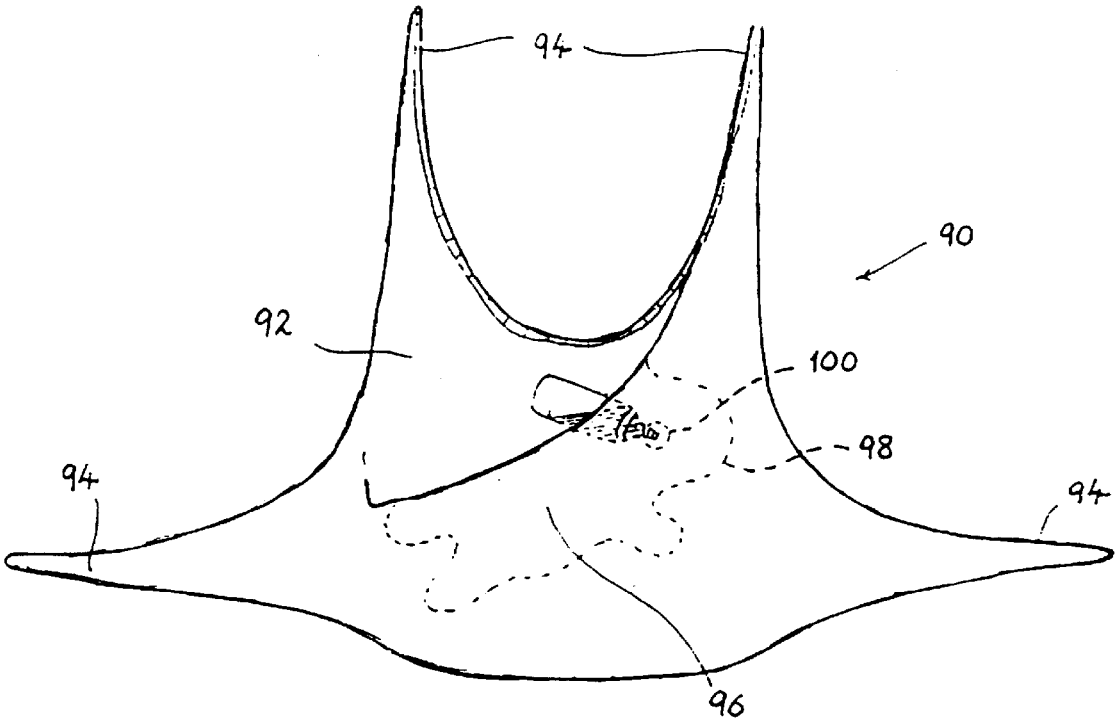
Figure 11:
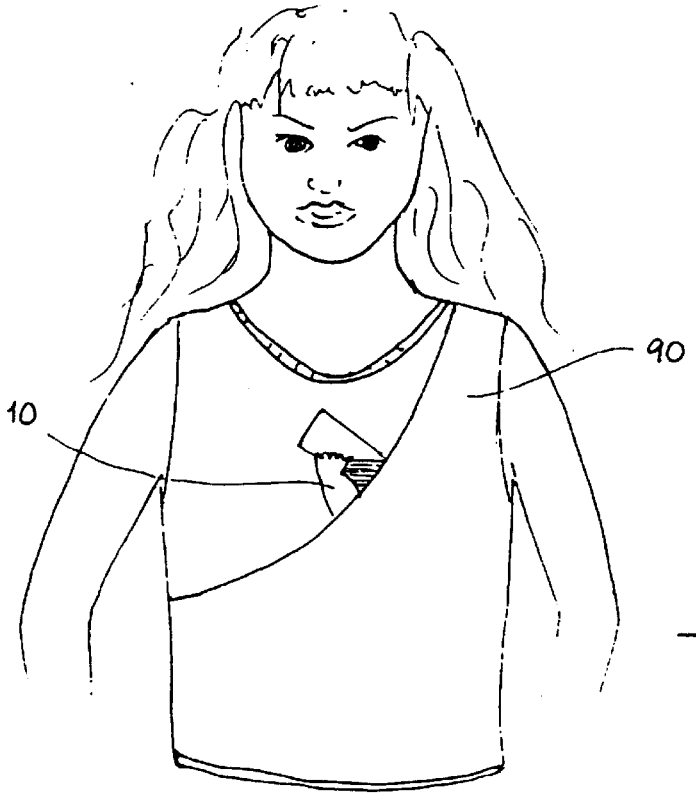
FIG. 11 illustrates the garment of FIG. 10 as worn by a child.

FIG. 10 illustrates one embodiment of a garment in the form of an apron 90 that can be worn by a child for carrying the doll 10. The apron 90 comprises a frontal piece which is fastened to the child by tying ties 94 around the waist and neck of the child. FIG. 11 illustrates the manner in which the garment 90 of FIG. 10 would be worn by a child for carrying the doll 10 therein in a feeding position. Sewn on the outside of the frontal piece 92 is a pouch 96 shaped to accommodate the doll 10 therein. A seam 98 within the pouch 96 is shown in broken outline and conforms generally to the shape of one side of the doll 10. Sewn into the frontal piece 92 is a magnet 100 positioned so as to overlay the breast of the child, generally in the region of one of the nipples of the child. If desired, a picture of a feeding bottle may be printed on to the frontal piece 92 or alternatively a representation of a breast nipple may be provided on the frontal piece over the magnet 100. The pouch 96 is designed so that when the doll 10 is received therein the head 12 of the doll rests over the magnet 100 with the mouth in close proximity thereto. Hence, the magnet 100 will provide the required external stimulus to close the magnetic switch 28 and activate the animation mechanism 20 as described above.

Figure 9:
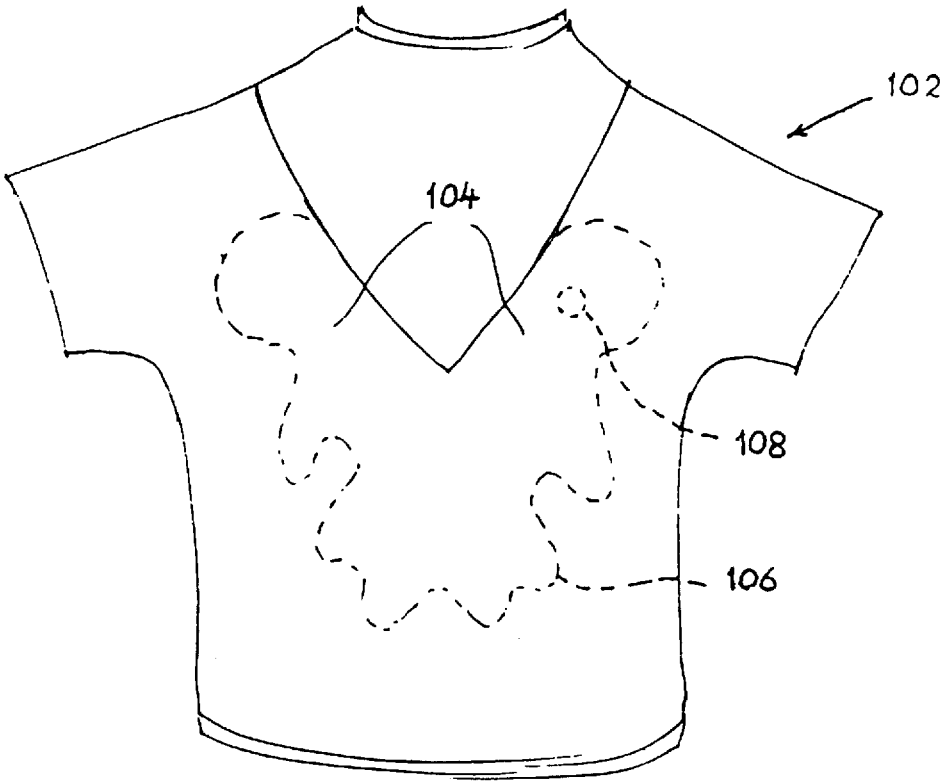
FIGS. 9, 10, and 12 are plan views of three alternative garments which can be used with the doll of FIG. 1.
Figure 12:
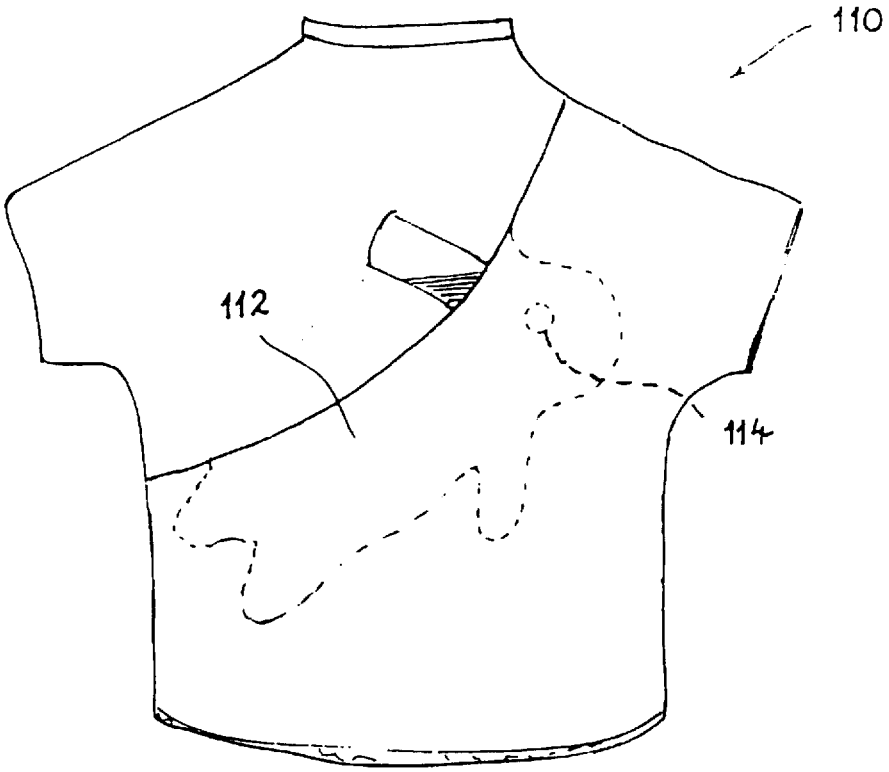

FIGS. 9 and 12 illustrate two alternative garments which may be used in a similar way to that of FIG. 10. FIG. 9 illustrates a smock or tee shirt 102 which is provided with a double pouch 104, the internal seam 106 of which can be seen in broken outline. The smock 102 also has a permanent magnet 108 sewn into the garment in the general region of one of the child's breasts. When the doll is placed in the pouch 104 with the head of the doll placed over the magnet 108, the animation mechanism 20 is activated in the sequence described above. However, the smock 102 also allows the doll to be carried without activating the animation mechanism 20, by moving the doll so that it lies with its head lying the other way. FIG. 12 illustrates a garment in the form of a tee shirt 110 provided with a pouch 112 similar to the pouch 96 of the apron 90 illustrated in FIG. 10, and is also provided with a permanent magnet 114 sewn therein.

It will be apparent that many other types of garments can be modified to carry the doll 10 therein and to provide the necessary external stimulus in the form of a magnetic field to activate the animation mechanism of the doll.

Now that a preferred embodiment of the doll and animation mechanism have been described in detail, it will be apparent that the play value of the doll is enormously enhanced by the responsive behaviour produced by the animation mechanism. A child playing with the doll becomes emotionally involved as it pretends to feed the doll and is rewarded by the movement of the doll's limbs, the sound of suckling and the heart beat felt on the chest of the doll. When the doll is carried in the pouch of a garment worn by the child, the doll rests against the body of the child and the doll's movement and heart beat can be felt by the child. This close physical contact between the doll and the child and the apparent responsive behaviour of the doll to the child's actions, create a bonding between the child and the doll and excite a strong emotional response from the child. If desired, the sound generating IC and the control circuit can be programmed to produce a variety of alternative sequences of responsive behaviour, to facilitate the play/acting of various scenarios by the child with the doll.

It will be apparent to persons skilled in the appropriate arts that numerous variations and modifications can be made to the doll and the animation mechanism, in addition to those already described, without departing from the basic inventive concepts. For example, it is unnecessary for the animation mechanism to also include a sound generating means and a heart beat mechanism, although clearly these additional features further enhance the play value of the doll. Furthermore, it is unnecessary that the animation mechanism need move all of the limbs of the doll. For example, the mechanism may be arranged to move only the arms or only the legs of the doll. Furthermore, although the illustrated embodiment employs a permanent magnet to provide the external stimulus and a magnetic switch as the sensing means, the external stimulus and sensing means may take other forms. For example, the sensing means may comprise a microphone for detecting an external stimulus in the form of a sound, for example, the characteristic sound of a toy rattle. When the rattle is sounded near the doll, the doll responds by moving its limbs and generating a gurgling or laughing sound. All such variations and modifications are to be considered within the scope of the present invention, the nature of which is to be determined from the foregoing description and the appended claims.

The claims defining the invention are as follows:

1. An animated doll having a head, torso and limbs, the doll further comprising:

an animation mechanism for moving a plurality of limbs of the doll, said animation mechanism being housed in a casing adapted to be received within the torso of the doll and comprising:

an electric motor;

a plurality of pivotal members, each pivotal member being adapted to extend into one of said plurality of movable limbs of the doll to transmit a pivoting movement to the limb;

a cam means comprising a plurality of lever arms each connected to one of said pivotal members and having a cam follower that engages with a wheel cam operatively coupled to said electric motor, a plane of rotation of said wheel cam and a plane of pivoting movement of said lever arms being substantially parallel to a plane that passes through both said torso and said plurality of limbs of the doll, wherein said cam means is adapted to produce an unco-ordinated movement of said plurality of limbs of the doll which appears to be less mechanical in nature and more life-like; and, a sensing means for detecting an external stimulus applied to the doll and for activating the animation mechanism when said external stimulus is detected whereby, in use, the doll appears to respond to the external stimulus by moving said plurality of limbs.

2. An animated doll as claimed in claim 1, wherein said cam follower is in the form of a slot provided in the lever arm, and said wheel cam is provided with a pin which is slidably received in said slot, and which produces an oscillating pivoting movement of said lever arm when the cam wheel rotates.

3. An animated doll as claimed in claim 2, wherein two wheel cams are provided, and wherein the lever arm connected to the pivotal member for a leg of the doll and the lever arm connected to the pivotal member for an opposite arm of the doll are driven by a common wheel cam.

4. An animated doll as claimed in claim 3, wherein each pivotal member is connected to a corresponding lever arm by a resilient means so as to permit the limb into which it extends to be bent without damaging the animation mechanism.

5. An animated doll as claimed in claim 4, wherein the animation mechanism further comprises a transmission means for transmitting and converting a relatively high speed rotation of the electric motor to a relatively low speed rotation of said wheel cams.

6. An animated doll as claimed in claim 1, wherein said animation mechanism further comprises a sound generating means operatively connected to said sensing means and adapted to generate a sound when said external stimulus is detected.

7. An animated doll as claimed in claim 6, wherein said sound generating means comprises an electronic circuit and a small audio transducer and is adapted to produce at least two different sounds, namely a suckling sound and a crying sound.

8. An animated doll as claimed in claim 1, wherein said animation mechanism also incorporates a heart beat mechanism operatively connected to the said sensing means and adapted to generate a simulated heart beat when said external stimulus is detected.

9. An animated doll as claimed in claim 8, wherein said heart beat mechanism is provided with a vibration transmitting member that terminates on a plate arranged external to said casing and located generally in the region where the sternum of the doll should be whereby, in use, said heart beat can be felt by touching the doll in the region of the sternum.

10. An animated doll as claimed in claim 1, wherein said sensing means comprises a magnetic switch located within the head of the doll in the general region of the mouth and said external stimulus is produced by a magnetic field brought into close proximity to the mouth of the doll.

11. An animated doll as claimed in claim 10, wherein said magnetic field is produced by a permanent magnet located in an external object which can be brought into close proximity to the mouth of the doll.

12. An animated doll as claimed in claim 11, wherein said doll is a toy baby human doll and said external object is a garment worn by a child playing with the doll, the permanent magnet being sewn into a frontal piece of the garment.

13. An animated doll as claimed in claim 11, wherein said external object is a simulated feeding bottle and said permanent magnet is located beneath a teat of the feeding bottle.

14. An animation mechanism for moving a plurality of limbs of a doll having a head and torso, the mechanism comprising:

an electric motor;

a plurality of pivotal members, each pivotal member being adapted to extend into one of said plurality of movable limbs of the doll to transmit a pivoting movement to the limb;

a cam means comprising a plurality of lever arms each connected to one of said pivotal members and having a cam follower that engages with a wheel cam operatively coupled to said electric motor, a plane of rotation of said wheel cam and a plane of pivoting movement of said lever arms being substantially parallel to a plane that passes through both said torso and said plurality of limbs of the doll, wherein said cam means is adapted to produce an unco-ordinated movement of said plurality of limbs of the doll which appears to be less mechanical in nature and more life-like.

* * * * *